United States Patent [19]

Sheinin et al.

[11] 4,164,198

[45] Aug. 14, 1979

[54] INSTALLATION FOR APPLYING A COAT TO THE ENTIRE INNER SURFACE OF A SECTIONALIZED HOLLOW ITEM

[75] Inventors: Evgeny I. Sheinin, Moscow; Nelli S. Belostotskaya, Reutovo; Lev N. Yakovlev, Zheleznodorozhny, all of U.S.S.R.

[73] Assignee: Gosudarstvenny Nauchno-Issle-Dovatelsky Institut Stroitelnoi Keramiki Niistroikeramika, U.S.S.R.

[21] Appl. No.: 846,565

[22] Filed: Oct. 28, 1977

[51] Int. Cl.[2] ..... B05C 7/04

[52] U.S. Cl. ..... 118/315; 118/317; 118/319; 134/167 R

[58] Field of Search ..... 118/56, 317, 319, 315, 118/7; 134/115 R, 167 R, 168 R, 104; 427/233

[56] References Cited

U.S. PATENT DOCUMENTS

| | | | |
|---|---|---|---|
| 2,216.698 | 10/1940 | Arey et al. | 134/167 R |
| 2,605,478 | 8/1952 | Lassiter | 134/168 R X |
| 3,011,911 | 12/1961 | Morey | 118/317 X |
| 3,813,299 | 5/1974 | Bugor | 134/168 R X |

*Primary Examiner*—John McIntosh

*Attorney, Agent, or Firm*—Robert E. Burns; Emmanuel J. Lobato; Bruce L. Adams

[57] ABSTRACT

Apparatus for application of a coat of coating material to hollow articles provided with at least one internal partition to divide the interior of said items into an entry and an exit portions having an inlet and an outlet openings, repsectively. The coat application unit has at least two sprayer heads each of which has a configuration corresponding to the shape of the area to be coated and is adapted to be passed though the inlet and the outlet openings into the entry and exit portions, respectively. One of the sprayers may be carried by a bracket arm which is locked-in with a tipper device and is provided with a retainer adapted to keep the article in position after the abovesaid sprayer has been fitted into the item under process for a conjoint turning of the item and the tipper to remove surplus coating material.

2 Claims, 5 Drawing Figures

INSTALLATION FOR APPLYING A COAT TO THE ENTIRE INNER SURFACE OF A SECTIONALIZED HOLLOW ITEM

BACKGROUND OF THE INVENTION

The present invention relates generally to the field of producing sanitary-engineering items and has particular reference to installations for applying a coat to the entire inner surface of sectionalized hollow items.

The present invention can find use for application of a coat to the entire inner surface of hollow items having at least one internal partition that divides the interior thereof into an entry and an exit portions having an inlet and an outlet opening, respectively. The invention is likewise practicable to be employed for applying glaze-coating to the inner surface of sanitary-engineering items, such as lavatory basins, bidets, etc.

The present-day state of the art knows a number of installations for applying a coat to the inner surface of sanitary-engineering items and some other stoneware.

To take an example, one prior-art installation for glazing white earthenware is known to comprise a rotor for dipping the items under treatment, said rotor having holders to grip the latter, and a glazing bath, the dipping rotor being followed by a drying rotor, and a swing pusher is provided between both of the rotors.

The afore-discussed installation operates as follows. The item to be glazed is pushed-fitted onto the dipping rotor rods by a chain feeder, whereupon the item is dipped in the glazing bath. Upon leaving the glazing bath the item is forwarded to the pusher which pushes over the item from the dipping roller rods onto the drying rotor rods. Further on, the item slips off the drying rotor rods to get onto the receptacle conveyor.

However, the abovementioned installation has the disadvantage that it makes use of a traditional technique for coating sanitary-engineering items, i.e., by dipping which is disadvantageous in failing to provide a uniformly spread coating, presence of glaze stains and runs, inability to obtain a coat thick enough due to a relatively low density of the glaze used in such method, and the like.

One more prior-art installation for glazing hollow stoneware is known to currently use, a carriage for items to be glazed provided with its traversing mechanism, a glaze sprayer device with its traversing mechanism, a glaze catcher pan with its traversing mechanism, and a tipper mechanism for items under processing, provided with an arresting device to fix the item being treated in position while being tipped over, fixing being attained due to clamping the item in between hold-downs traversable from above downwards by air-operated cylinders, and the carriage bearing surface.

The installation discussed above operates as follows. The item to be glazed is fed by the carriage under the glass sprayer device, the glaze catcher pan is moved aside, while the glaze sprayer is sunk into the bowl of the item under processing; concurrently, glaze starts to be fed to the sprayer device. Next the glaze sprayer is raised, the glaze catcher pan is placed in position and the tipper turns over the item so as to let surplus glaze run down. This done, the tipper returns the item into the initial position, whereupon the hold-downs are actuated by their air cylinders to release the item.

However, the construction of the installation fails to provide the production of quality finished items featuring fully glazed inner surfaces, which may be attributed to the following reasons:

1. construction of the tipper mechanism involves the provision of special arresting devices to retain the items in place by forcing them against the swivel platform while being tipped over which, apart from substantial siphistication of the construction, is inescapably causative of collapsing the items under treatment that is liable to occur rather infrequently due to permissible and actually encountered scattering of height dimensions thereof, i.e., items featuring the height dimension in excess of the rated value get crushed while being held down, whereas those with the height short of the rated value fail to be held in place and thus fall out while being tipped over.

2. The inner surface of the siphon (or trap) of the basin fails to be glazed due to an air lock formed in the top portion of the trap and owing to the absence of a special device for glazing said surface, which is inadmissible.

3. No provision of any means masking the outer surface of the item under treatment in the installation results in that the drops and runs of the glaze make their way onto the outer surface, thus affecting adversely the trade appeal and quality of the finished items.

SUMMARY OF THE INVENTION

It is a primary and essential object of the present invention to attain coat application to the entire inner surface of a hollow item wherein internal partitions and inlet and outlet openings are provided.

It is another object of the present invention to provide high quality of the coat being applied.

It is still another object of the present invention to attain higher operational reliability of the installation for applying a coat to hollow items.

It is one more object of the present invention to simplify the construction of the installation.

These and other objects are accomplished due to the fact that an installation for applying a coat to the entire inner surface of a hollow item divided by at least partition into an entry and an exit portions having an inlet and an outlet openings, respectively, comprising a coat application unit and a tipper adapted to turn over the item under treatment with a view to eliminate surplus coating material, according to the invention incorporates also at least two sprayer heads, of which each is adapted to be introduced through the inlet and the outlet openings into the entry and the exit portions, respectively, and has configurations conforming to the shape of the areas to be coated, whereas one of the sprayers is carried by a bracket arm locked-in with the tipper and provided with an arrester to retain the item after said sprayer has been introduced thereinto, for a conjoint turning of the item and the tipper to remove surplus coating material.

In order to apply a coat to the entire inner surface of a lavatory basin it is expedient that one of the sprayers be positioned vertically and the other sprayer, horizontally and be made as a tube perforated both peripherally and at the end face thereof, both of the sprayers being connected to the source of the coating material through a spray-control valve for the coat to be applied to the entire inner surface of lavatory basin at a time, and that the arrester retaining the basin while the latter is being turned along with the tipper, be made of a resilient material.

Such a constructional arrangement of the installation enables one to apply coat to the entire surface of sectionalized hollow items and ensure high quality coating, while concurrent operation of the sprayers makes it possible to intensify the coating process.

BRIEF DESCRIPTION OF THE DRAWINGS

In what follows the present invention is disclosed in a detailed description of a specific embodiment thereof to be read in conjunction with the accompanying drawings, wherein.

DESCRIPTION OF THE PREFERRED EMBODIMENT

Figure 1:
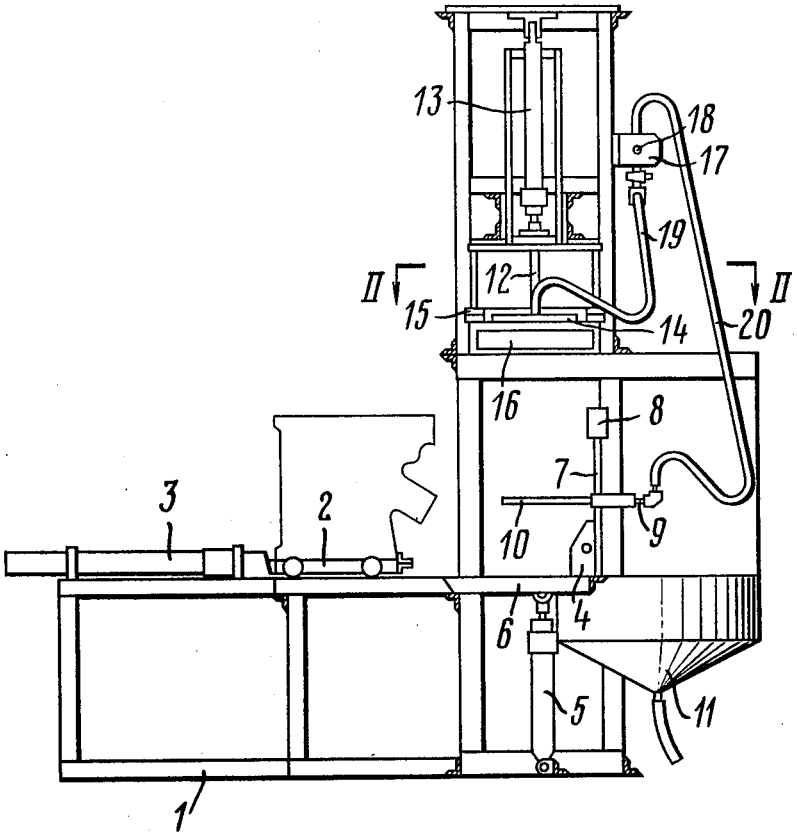
FIG. 1 is a general schematic, partly longitudinal-section view of an installation for applying a coat to the entire inner surface of a hollow item, according to the present invention, as shown in the initial position thereof.
Figure 2:
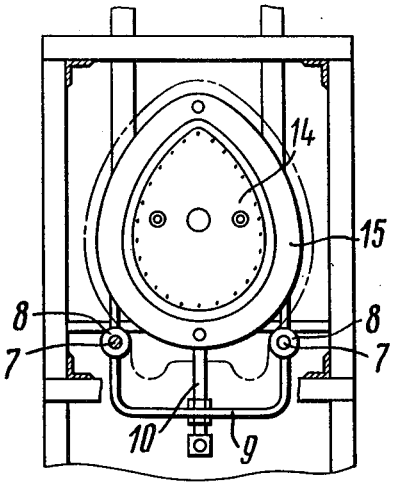
FIG. 2 is a section taken along the line II—II in FIG. 1.
Figure 3:
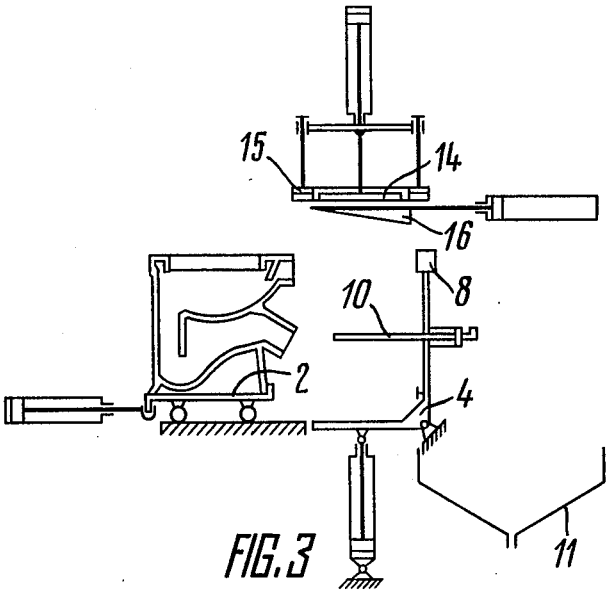
FIG. 3 shows the functional diagram of the installation while in the initial position.
Figure 4:
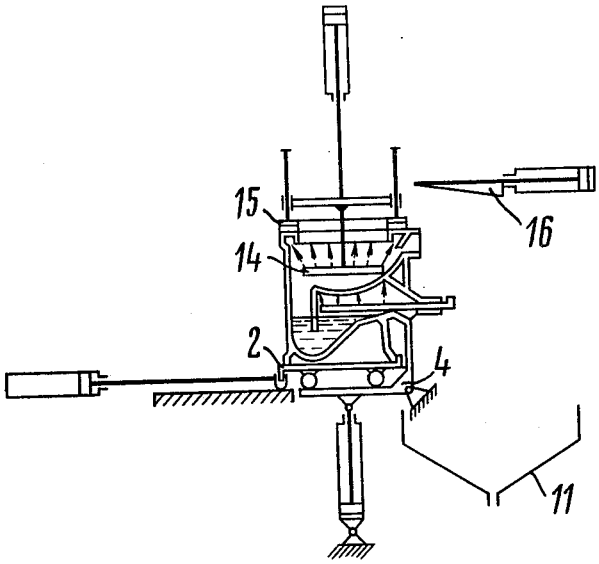
FIG. 4 shows the functional diagram of the installation while a coat is being applied to the item.
Figure 5:
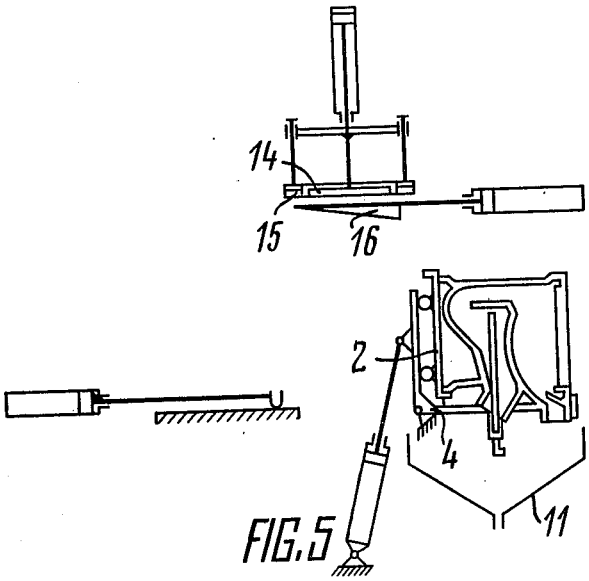
FIG. 5 shows the functional diagram of the installation while surplus coating material is being removed.

Now referring to the accompanying drawings, the installation for applying a coat to the entire inner surface of a sectionalized hollow item as shown in FIGS. 1, 2, 3, 4, 5, comprises a frame 1 in whose bottom portion a carriage 2 for the items to be coated is provided, having a mechanism 3 for its traversing, a tipper 4 incorporating a swivel platform 6 connected to the rod of a hydraulic cylinder 5 which is pivotally mounted on the frame 1, said platform 6 carrying a bracket arm locked-in therewith and made up by two uprights 7 stop of which retainers 8 are provided, made of a soft resilient material and adapted to protect the lavatory basin against being broken while tipped over for the excess glaze to be let out. A yoke 9 adjustable for height is carried by the uprights 7, said yoke 9 mounting the sprayer head fixed in the horizontal position thereon, which head is made as a tube 10 perforated both peripherally and at the end face thereof. A receptacle 11 for surplus glaze to hold is provided beneath the tipper 4.

The top portion of the frame incorporates the following devices:

(a) A coat applying unit 12, comprising a vertical hydraulic cylinder 13 whose rod carries a sprayer head held in place thereto.

The sprayer head 14 may be made as, say, a hollow plate whose configuration follows that of the bowl of the lavatory basin and has a number of holes located in the top portion thereof and arranged peripherally at a certain angle to the horizontal plane, the holes are adapted for the glaze to feed under the basin ring.

To ensure against getting the coat onto the outer surface of the item under processing, it is expedient that the installation be provided with a protector device which can be situated on, say, the coat applying unit 12 and be made as a frame 15 vertically traversable along with the rod of the hydraulic cylinder 13 and having an opening for the sprayer head 14 to pass. It is likewise practicable that the surface of the frame 15 in contact with the item under processing be lined with a soft resilient material.

(b) A surplus glaze catcher pan 16 with its traversing mechanism and a spray-control valve 17 connected at one end to a glaze pipe 18 running from the feed pump, and at the other end, to the sprayer head 14 and the perforated tube 10 through flexible pipings 19 and 20.

The installation of the invention operates as follows. The carriage 2 carrying the item to be glazed is traversed to the glazing position; at the same time the perforated tube 10 passes through the outlet opening of the item to get into the cavity thereof which may be a siphon (trap) thereof. Next the glaze catcher or drip pan 16 is moved out of position, and the sprayer head 14 along with the protector frame 15 is actuated by the hydraulic cylinder 13 to sink into the bowl of the lavatory basin; as a result, the protector frame 15 comes down upon the top surface of the item closing the cavity, whereupon the spray-control valve 17 operates to clear a free passage for the glaze to the sprayer head 14 and the perforated tube 10 so as to carry out a simultaneous coating of the inner surface of the item being processed. Once the preset period of time (which can be set by, say, adjusting an appropriate timer), has elapsed, the spray-control valve 17 is closed to out off the feed of glaze. Thereupon, the sprayer head 14 along with the protector frame 15 is raised into the initial position, the glaze catcher pan 16 is moved in position under the sprayer head 14. This done, the tipper 4 turns over the carriage 2 with the item through 90° so as to let surplus glaze run down from the siphon of the lavatory basin into the receptacle 11. This over, the tipper 4 returns the item into the vertical position. Finally, the carriage 2 with the item is retracted into the initial position, where the glazed item is taken out, and a next one is placed instead.

As distinct from the known installations of the same purpose the herein-proposed one enables mechanization of the coat application process and is capable of high-quality coating of the entire inner surface of hollow items.

A simultaneous coating of the surface by both of the sprayers substantially outs down the time taken by the coating process itself.

What is claimed is:

1. Apparatus for applying a coating on inner surfaces of a cavity in an article of manufacture comprising, a carriage movable to a spray station and retractable therefrom selectively, means for moving said carriage to said station and retracting it therefrom, said carriage comprising means for mounting and releasably holding an article of manufacture having a cavity open on a top end of the cavity and closed at the bottom thereof and a lateral opening into said cavity intermediate the open top of the cavity and closed bottom thereof, a tiltable device at said spray station comprising means for receiving said carriage with said article thereon and releasably holding said carriage in a tilted position, means for selectively tilting said tiltable device to a tilted position for tilting said article for draining excess coating material therefrom through said lateral opening, spray mechanism comprising a first spray device insertable into said cavity of said article through said lateral opening for spraying upwardly a coating material in said cavity and allowing coating material to drain to the bottom of the cavity, a second spray device in said spray mechanism insertable into said cavity through said top opening and spraying coating material along upper peripheral interior edges of said cavity and allowing coating material to drain to said closed bottom, said spray mechanism including a closure device movable into position overlying said top opening and closing said cavity during spraying of said coating material, means for automatically moving and actuating said first and second spray device and said closure in timed relationship, and receptacle means disposed for receiving excess coating material drained from the bottom and interior of said cavity through said lateral opening upon cessation of spraying in said cavity and said article is tilted to drain said excess coating material.

2. Apparatus for applying a coating on inner surfaces of a cavity in an article of manufacture according to claim 1, including a drip pan movable into position underlying said second spray device when said second spray device is in a retracted position outwardly of said cavity, and means for automatically moving said drip pan into said underlying position and to a retracted position to allow said second spary device to be lowered into said cavity.

* * * * *